United States Patent [19]

Wielebski et al.

[11] 4,158,836

[45] Jun. 19, 1979

[54] SOLID STATE TIMER FOR SEALED CONTACT RELAY

[75] Inventors: Wayne H. Wielebski, Milwaukee; Joseph D. Radtke, Cudahy, both of Wis.

[73] Assignee: Allen-Bradley Company, Milwaukee, Wis.

[21] Appl. No.: 900,477

[22] Filed: Apr. 27, 1978

Related U.S. Application Data

[63] Continuation of Ser. No. 685,700, May 12, 1976, abandoned.

[51] Int. Cl.[2] ..... G08B 1/00

[52] U.S. Cl. ..... 340/309.1; 340/309.4

[58] Field of Search ..... 340/309.1, 309.4; 307/141; 317/113

[56] References Cited

U.S. PATENT DOCUMENTS

| | | | |
|---|---|---|---|
| 3,407,312 | 10/1968 | Pearse | 307/141 |
| 3,809,965 | 5/1974 | Groth | 317/113 |

*Primary Examiner*—Harold I. Pitts

*Attorney, Agent, or Firm*—Quarles & Brady

[57] ABSTRACT

A sealed contact relay for use in industrial control systems includes a solid state digital programmable timer which controls the operation of a timed relay coil. An instantaneous relay coil is also included and each of the coils operates two sealed contact switches which are contained in field replaceable cartridges. A timing light indicates the state of the timed relay coil and it blinks while the digital programmable timer is timing. The timer mode and the duration of the timed interval are selected by placing a uniquely molded insert into a four-pole switch receptacle.

7 Claims, 7 Drawing Figures

$V_{DD}$

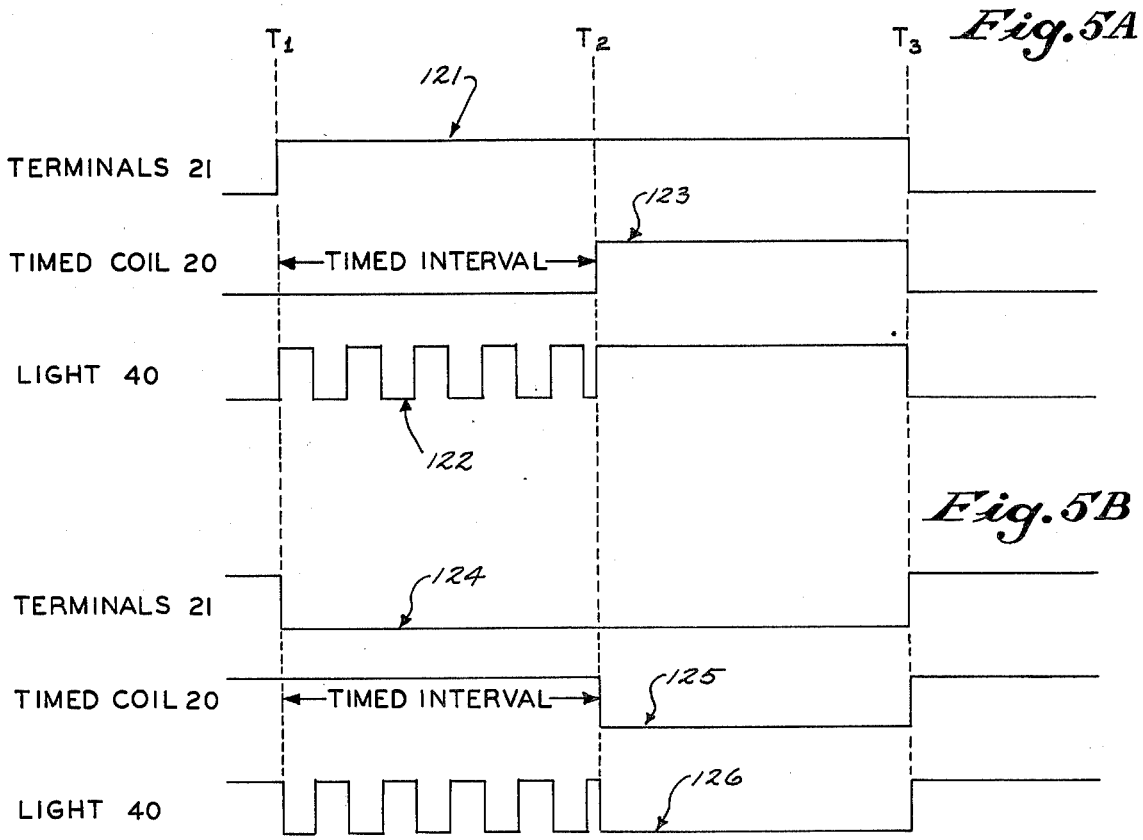
Fig. 5A
T1
T2
T3
121
TERMINALS 21
123
TIMED COIL 20
TIMED INTERVAL
LIGHT 40
122
Fig. 5B
124
TERMINALS 21
125
TIMED COIL 20
TIMED INTERVAL
126
LIGHT 40
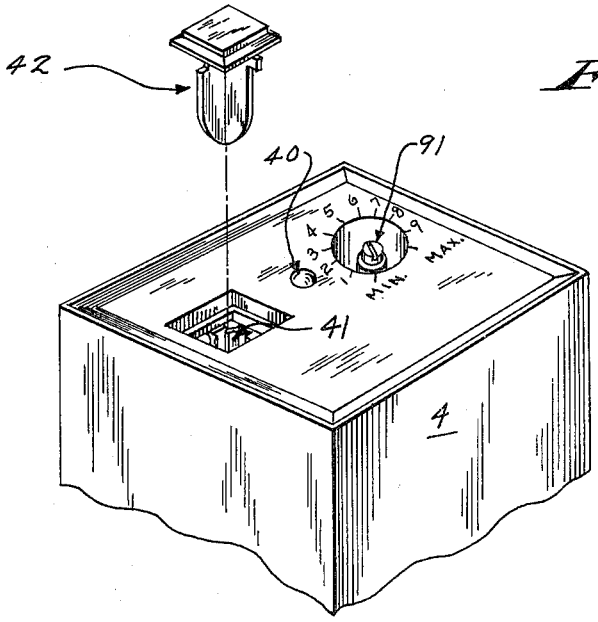
42
Fig. 6
40
91
MIN.
MAX.
41
4

SOLID STATE TIMER FOR SEALED CONTACT RELAY

RELATED APPLICATION

This is a continuation of application Ser. No. 685,700, filed May 12, 1976, now abandoned.

BACKGROUND OF THE INVENTION

The field of the invention is electrical relays which employ magnetically responsive sealed switches, and more particularly, relays such as that disclosed in U.S. Pat. No. 3,605,049 issued on Sept. 14, 1971, and entitled "Sealed Contact Relay".

Such sealed contact relays are known for their high reliability, speed of operation and suitability for use in adverse operating conditions. They are typically interconnected with other similar relays and mounted within a common cabinet to form a control system for industrial equipment such as molding machines, metalworking machines and transfer lines.

Control systems formed from sealed contact relays must often perform timing functions. Timing modules are offered by a number of manufacturers which may be employed either as separate units in the control system or which may be mounted to a conventional relay as an optional feature. Timers must be reliable, rugged, compact and accurate for use in relay control systems and they have heretofore employed either mechanical timer mechanisms or analog electrical circuits such as that disclosed in U.S. Pat. No. 3,249,771, issued on May 3, 1966, and entitled "Stabilized Timing Circuit". Mechanical timers include expensive components and analog electrical timing circuits must be individually calibrated during manufacture which adds considerably to their cost.

SUMMARY OF THE INVENTION

The present invention relates to a timer for a sealed contact relay and more particularly, to a sealed contact relay which includes an actuation circuit having a pair of input terminals for receiving an actuation signal and an output terminal at which a logic signal responsive to the actuation signal is generated, a programmable digital timer having an input connected to the output of the actuation circuit, and an output terminal at which a selected logic signal is generated a preset time interval after the application of a selected logic signal to its input, and a driver circuit having an input connected to the programmable digital timer output and having a pair of output terminals which connect to a relay coil for energizing the same when said preselected logic signal is generated at the programmable timer output.

The invention further resides in a light driver circuit which connects to the input and the output of the programmable timer and which is responsive to the logic signals thereat to drive a light. When the programmable timer is timing, the light is alternately turned on and off (blinking) and when the programmable timer times out, the light assumes the same state as the relay coil.

Yet another aspect of the invention is the physical arrangement of circuit elements within the relay including the power supply, relay coil, magnetic circuit, and sealed contact switch cartridges. The power supply is contained within a base section, the relay coil, magnetic circuit and sealed switch cartridges are contained within an energizing and switch section which mounts atop the base section, and the programmable timer is enclosed in a timer section which mounts atop the energizing and switch section.

A general object of the invention is to provide a durable and accurate timer for a sealed contact relay. The digital programmable timer is a relatively small and rugged integrated circuit. By physically separating it from the power supply and the heat which it generates, the accuracy of the programmable timer can be maintained over a wide range of ambient operating temperatures and over a wide range of selectable time intervals. No calibration is required during production.

A further object of the invention is to provide a visual indication of the state of the programmable timer. The light driver circuit is contained within the timing section and the timing light is mounted therein and positioned so that it is readily visible when the relay is mounted within a control system. As the timer is timing the light blinks, and when it times out, the light remains energized or deenergized to indicate the state of the relay coil.

Another object of the invention is to provide a programmable digital timer which is suitable for use in an industrial environment. The power supply employs a transformer which enhances isolation of the digital programmable timer from line transients and the actuation circuit includes an optical isolator which provides both electrical and physical isolation from industrial noise.

Another object of the invention is to provide a timer having a number of selectable time delays. Four time periods are possible, and each is selectable by applying a unique two-bit digital code to the digital programmable timer circuit.

A more specific object of the invention is to provide a number of selectable modes of timer operation. Logic gates associated with the programmable timer allow it to operate in any of a number of modes, including on delay and off delay.

Yet another more specific object of the invention is to provide a means which facilitates selecting the desired mode of timer operation and the desired time interval. Any one of the modes of operation can be selected with any one of the four time delays by plugging a molded insert into a four-pole switch receptacle. The poles of the switch receptacle are connected to the digital programmable timer and its associated logic circuitry to select a time interval and a mode of operation. Any one of the uniquely shaped molded inserts may thus be plugged into the switch receptacle to provide the desired mode of operation and desired timing interval.

Yet another more specific object of the invention is to provide a timer which operates field replaceable sealed contacts. The driver circuit energizes a relay coil which generates magnetic flux through a set of flux fingers. Field replaceable cartridges, each containing a sealed contact switch, are mounted in compartments formed between the flux fingers and these may be easily removed and replaced by maintenance personnel. Normally open and normally closed cartridges can be used interchangeably.

The foregoing and other objects and advantages of the invention will appear from the following description. In the description reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

BRIEF DESCRIPTION OF THE DRAWINGS

FIG. 6 is a partial perspective view of the sealed contact relay of FIG. 1.

DESCRIPTION OF THE PREFERRED EMBODIMENT

Figure 3:
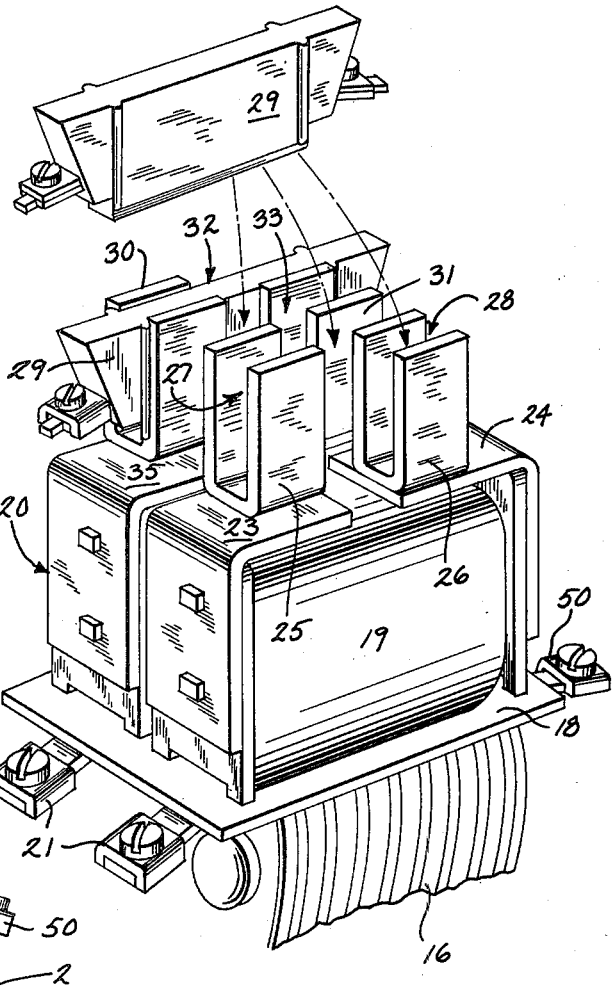
FIG. 3 is a partial perspective view of the energizing and switch section which forms part of the sealed contact relay of FIG. 1.
Figure 1:
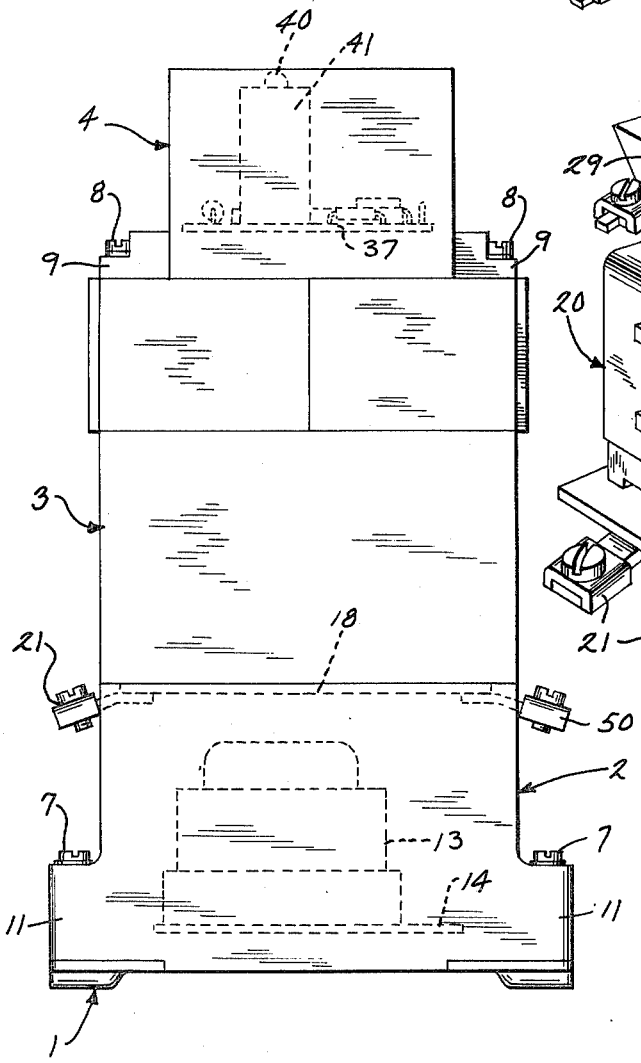
FIG. 1 is a side elevation view of a sealed contact relay which employs a timer of the present invention.
Figure 2:
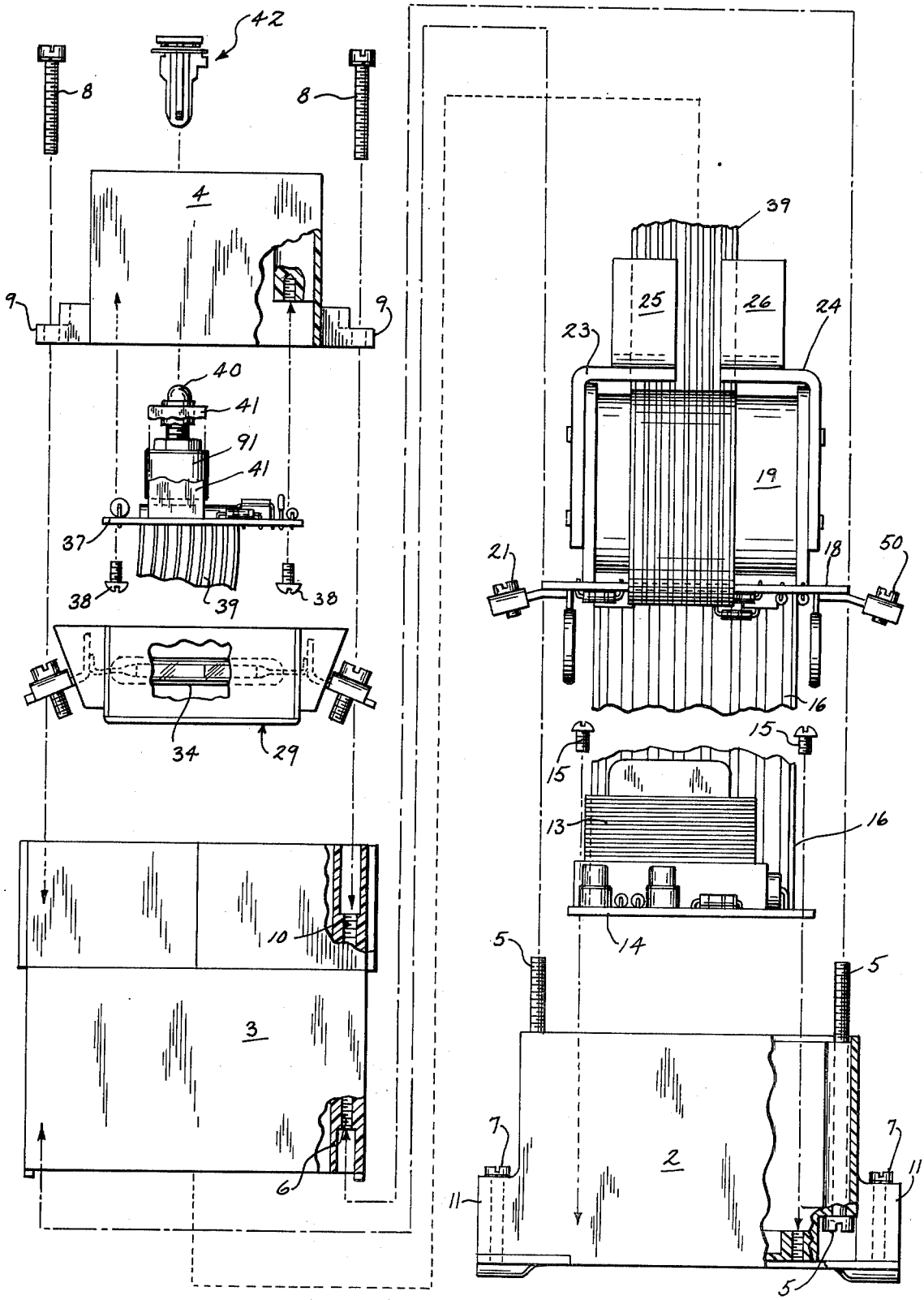
FIG. 2 is an exploded view of the sealed contact relay of FIG. 1.

Referring particularly to FIGS. 1 and 2, the sealed contact relay includes a metal mounting plate 1, a molded plastic base section housing 2, a molded plastic energizing and switch section housing 3, and a molded plastic timing section housing 4. The energizing and switch section housing 3 is fastened to the base section housing 2 by a set of screws 5 which extend upward from beneath the housing 2 and are received in aligned threaded openings 6 formed on the underside of the housing 3. The base section housing 2 is fastened to the mounting plate 1 by a set of screws 7 which extend downward through integrally formed feet portions 11 into threaded openings formed in the mounting plate 1. The mounting plate 1 is suitable for attachment to a mounting track (not shown in the drawings) or the back wall of a cabinet (not shown in the drawings) which houses the control system of which the relay is a part. The timing section housing 4 is fastened in place atop the relay by a set of screws 8, which pass downward through openings formed in flanges 9 that extend outward from the housing 4, and which are received in aligned threaded openings 10 formed in the housing 3. The housings 2, 3 and 4 are substantially rectangular in shape and they enclose the elements of the sealed contact relay which are now to be described. The size and general appearance of the structure thus formed is substantially the same as a standard sealed contact relay such as that disclosed in the above cited U.S. Pat. No. 3,605,049.

Mechanical Description

The base section housing 2 serves as an enclosure for a power supply indicated generally at 12. The power supply includes an isolation transformer 13 which is mounted with other circuit elements to a circuit board 14 that is fastened to the bottom of the housing 2 by a set of screws 15. The power supply 12 is electrically connected to other elements in the relay as will be described hereinafter by a flexible cable 16.

The energizing and switch section housing 3 supports a second circuit board 18 which in turn mounts an instantaneous relay coil 19 and a timed relay coil 20. The driving circuits for the coils 19 and 20 are mounted to the bottom side of the board 18 and face downward into the space defined by the base section housing 2. A pair of timed control terminals 21 extend outward from one end of the board 18 and a pair of power supply terminals 50 extend outward in the opposite direction. The circuit board 18 connects to the power supply circuit board 14 through the flexible cable 16.

The housing 3 encloses the relay coils 19 and 20 and their associated magnetic circuits. The instantaneous relay coil 19 supports a magnetic circuit which is comprised of a pair of L-shaped legs 23 and 24 and a pair of U-shaped flux finger elements 25 and 26. Each flux finger element 25 and 26 defines a respective compartment 27 and 28 into which a sealed contact switch cartridge 29 may be inserted. Similarly, the timed relay coil 20 supports a magnetic circuit which includes a pair of L-shaped legs 35 and a pair of U-shaped flux finger elements 30 and 31 that define two additional cartridge compartments 32 and 33. The elements of the magnetic circuits are made of a low reluctance material such as steel.

When the relay coil 19 is energized, the magnetic flux which it generates is conducted through the leg portions 23 and 24 of its associated magnetic circuit, and this flux is diverted by the flux finger elements 25 and 26 upward and through a switch cartridge 29 disposed in one of the compartments 27 or 28. As shown best in FIG. 2, each switch cartridge 29 includes a sealed contact switch 34 which provides a relatively low reluctance path that extends between the flux finger elements 26 and 27 to complete the magnetic circuit. As is well known in the art, the contacts in the sealed contact switch 34 are operated in response to the magnetic flux which flows therethrough, and they are thus operated by the relay coil 19. The timed relay coil 20 and its associated magnetic circuit function in a similar manner to operate sealed contact switches 34 which are contained in cartridges 29 disposed in the compartments 32 and 33. As will be described in more detail hereinafter, however, the timed relay coil 20 is coupled to the output of the digital programmable timer and is not necessarily operated at the same time as the instantaneous relay coil 19. For a more detailed description of the magnetic circuit, cartridges and sealed contact switches therein, reference is made to the above cited U.S. Pat. No. 3,605,049 entitled "Sealed Contact Relay".

Referring to FIGS. 1, 2 and 6, the housing 4 which mounts atop the relay encloses a timing circuit board 37 which is fastened in place by a set of screws 38. The timing circuit board 37 is electrically connected to the circuit board 14 by a flexible cable 39, and among other elements, it mounts a digital programmable timer 75 which is contained within a dual in line package. The circuit board 37 also supports a timing light 40 and a potentiometer 91 which extend upward therefrom and through openings in the top surface of the enclosure 4. It also supports a four-pole switch receptacle 41 which is substantially rectangular in shape and which extends upward through a rectangular opening in the top surface of the enclosure 4. The receptacle 41 is a series 300 data module commercially available from Interswitch and when a shaped molded insert 42 is plugged into it, the four poles, or switches, contained therein are selectively operated. Eight uniquely shaped inserts 42 are provided, and as will be described in more detail hereinafter, the insertion of any one of these inserts 42 will select a mode of timer operation and one of four time intervals. The relay may thus be easily "programmed" by the user.

Electrical Description

Figure 4:
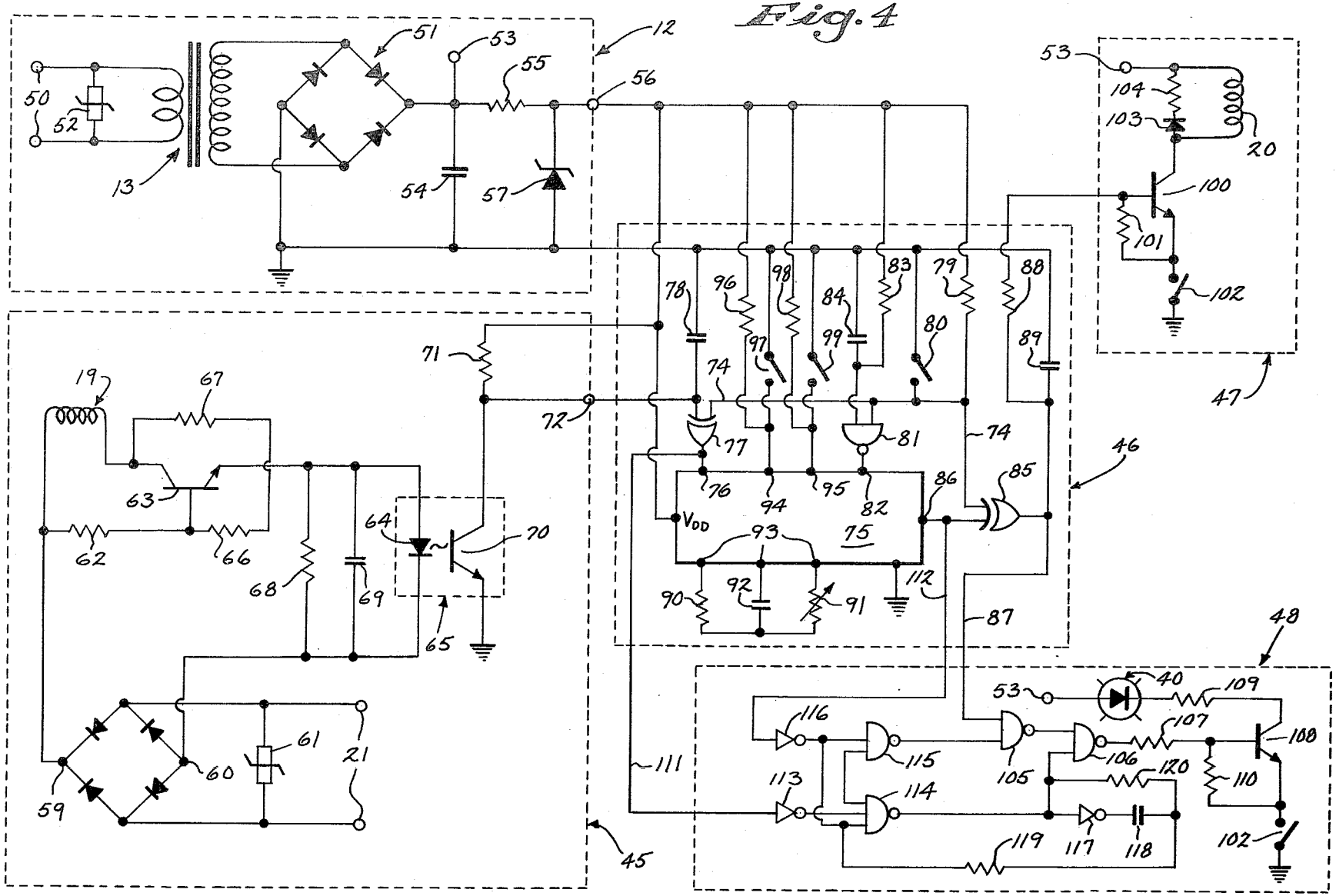
FIG. 4 is an electrical schematic diagram of the sealed contact relay of FIG. 1, FIGS. 5*a* and 5*b* are graphs which illustrate two modes in which the sealed contact relay of FIG. 1 may be operated.

Referring particularly to FIG. 4, the elements of the electrical circuit which are disposed on the circuit boards 14, 18 and 37 comprise the power supply 12, an actuation and driver circuit 45, a programmable timer circuit 46, a driver circuit 47 and a light driver circuit 48. Substantially all the elements of the programmable timer 46 and light driver circuit 48 are mounted on the timer circuit board 37, the elements of the actuation and driver circuit 45 and the driver circuit 47 are mounted on the circuit board 18, and the elements of the power supply 12 are mounted on the circuit board 14. The flexible cables 16 and 39 provide electrical connection between the circuit boards 14, 18 and 37.

Referring particularly to FIG. 4, the power supply 12 includes the isolation transformer 13 which has a primary winding connected to a pair of 120-volt a-c input terminals 50 and a secondary winding connected to the inputs of a full-wave bridge rectifier circuit 51. A varistor 52 connects across the terminals 50 to provide added protection from line transients. One output terminal on the bridge rectifier circuit 51 connects to circuit ground and the other output thereof connects to a power supply terminal 53. A filter capacitor 54 and a resistor 55 also connect to the rectifier circuit output, and the other lead on the resistor 55 connects to a regulated power supply terminal 56. A zener diode 57 connects between the terminal 56 and circuit ground to clamp the voltage at 11 volts.

The actuation and driver circuit 45 includes a full-wave bridge rectifier circuit 58 which has a pair of input terminals connected to the timed control terminals 21 and a pair of output terminals 59 and 60. A varistor 61 connects across the timed control terminals 21 to provide added protection from high voltage line transients. The output terminal 59 on the bridge rectifier circuit 58 connects to one terminal on the instantaneous relay coil 19 and it connects through a coupling resistor 62 to the base of an NPN drive transistor 63. The collector on the transistor 63 connects to the other terminal on the instantaneous relay coil 19 and its emitter connects through a light emitting diode portion 64 of an optical isolator circuit 65 to the output terminal 60 on the bridge rectifier circuit 58. A bias resistor 66 connects between the base and emitter of the transistor 63 and a dropout resistor 67 connects between the collector and emitter of the transistor 63. A bleeder resistor 68 and filter capacitor 69 connect between the emitter of transistor 63 and the bridge rectifier output terminal 60. The optical isolator 65 is a commercially available device such as JEDEC No. 4N35 manufactured by Optron, Inc., and it includes a transistor portion 70 that has an emitter which connects to signal ground and a collector which connects through a load resistor 71 to power supply terminal 56. The collector of transistor portion 70 serves as the circuit output terminal 72.

When a 120-volt a-c signal is applied to the terminals 21, the drive transistor 63 is turned on and current flows through the relay coil 19 to instantaneously energize it. A portion of the current conducted by the transistor 63 flows through the light emitting diode portion 64 of the optical isolator 65 and the transistor portion 70 therein is driven into saturation. The voltage at the circuit output terminal 72 is thus driven from a logic high voltage to a logic low voltage. When the 120-volt a-c signal is removed from the terminals 21, the d-c voltage generated across the bridge rectifier output terminals 59 and 60 drops to zero, causing the instantaneous relay coil 19 to become deenergized and the transistor 63 to become nonconductive. Current also ceases to flow through the light emitting diode portion 64 of the optical isolator 65 and its transistor portion 70 becomes nonconductive. The voltage at the circuit output terminal 72 thus rises from a logic low voltage to a logic high voltage when the input signal is removed. For a more detailed description of the manner in which the drive transistor 63 and associated resistor 62, 66 and 67 operate, reference is made to U.S. Pat. No. 3,666,998 issued to Wayne H. Wielebski on May 30, 1972.

The actuation and driver circuit 45 operates the programmable timer 46 which is comprised of the oscillator/timer 75 and supporting logic circuitry. The oscillator/timer 75 is a commercially available integrated circuit such as No. MC14541 manufactured by Motorola Semiconductor Products, Inc. and it has a reset terminal 76 which is coupled to the output terminal 72 on the actuation and driver circuit 45 through an exclusive OR gate 77. A noise filter capacitor 78 also connects to the exclusive OR gate 77, and a second input on the exclusive OR gate 77 connects to a lead 74. The lead 74 connects through a coupling resistor 79 to the power supply regulated output terminal 56, and it connects to circuit ground through one pole 80 of the four-pole switch receptacle 41. The lead 74 also connects to one input on a NAND gate 81 which drives a set terminal 82 on the oscillator/timer 75, and a second input on the NAND gate 81 is connected to the power supply output terminal 56 through a second coupling resistor 83. An initial set capacitor 84 connects the second input on the NAND gate 81 to circuit ground. The lead 74 also connects to one input of an output exclusive OR gate 85. A second input on the exclusive OR gate 85 connects to an output terminal 86 on the oscillator/timer 75 and the output of gate 85 connects to the light driver circuit 48 through a lead 87 and couples to the driver circuit 47 through a resistor 88. A noise filter capacitor 89 connects the output of the exclusive OR gate 85 to circuit ground.

The oscillator/timer 75 is comprised primarily of an inverter oscillator (not shown in the drawings) and a binary counter (also not shown in the drawings). The frequency at which the inverter oscillator is operated, and thus the rate at which the binary counter is incremented is determined by a timing resistor 90, a potentiometer 91 and a timing capacitor 92 which connect to a set of three terminals 93 on the oscillator/timer 75. In the preferred embodiment, an oscillator frequency of from 55 Hertz to 6.5 Kilohertz is selected by the potentiometer 91 and in combination with the inserts 42 provide a minimum selectable time interval of 0.1 seconds and a maximum selectable time interval of 120 seconds. The oscillator/timer 75 also includes a decoder circuit (not shown in the drawings) which has four inputs connected to selected stages on the binary counter and an output which is connected to the output terminal 86 of the oscillator/timer 75. A pair of control terminals 94 and 95 control the interval decoder circuit to select one of the four counter stages as the output of the programmable timer. Thus, by applying appropriate logic signals to the control terminals 94 and 95, a time interval may be selected. The control terminal 94 connects to the logic high power supply terminal 56 through a third coupling resistor 96 and it connects to logic low circuit ground through a second pole 97 on the four-pole switch receptacle 41. The control terminal 95 similarly connects to the logic high power supply output terminal 56 through a fourth coupling resistor 98 and to circuit ground through a third pole 99 on the four-pole switch receptacle 41.

The driver circuit 47 is controlled by the output exclusive OR gate 85 in the programmable timer circuit 46. It includes an NPN power transistor 100 which has its base connected to the resistor 88 and its collector connected to one terminal on the timed relay coil 20. A bias resistor 101 connects the base of transistor 100 to its emitter and the emitter connects to signal ground through a fourth pole 102 on the four-pole switch receptacle 41. The other terminal on the timed relay coil 20 connects to the unregulated power supply terminal 53 and a diode 103 and resistor 104 are connected in shunt with the coil 20.

When the switch pole 102 is closed, and the base of transistor 100 is driven to a logic high voltage level by the programmable timer circuit 46, the transistor 100 is driven into saturation and current flows through the timed relay coil 20 to energize it. When the base of the transistor 100 is driven to a logic low voltage level by the programmable timer circuit 46, the transistor 100 is turned off and the timed relay coil 20 is deenergized. The timed relay coil is thus controlled by the programmable timer circuit 46.

The light driver circuit 48 is also connected to the output of the exclusive OR gate 85 through the lead 87. The lead 87 couples through a first NAND gate 105, a second NAND gate 106 and a resistor 107 to the base of an NPN power transistor 108. The collector of transistor 108 connects through a resistor 109 to the light emitting diode (LED) timing light 40 which in turn connects to the unregulated power supply terminal 53. The emitter of transistor 108 connects to its base through a bias resistor 110 and it connects to circuit ground through the fourth pole 102 on the four-pole switch receptacle 41. The timing light 40 is thus controlled in part by the logic state of the exclusive OR gate 85 in the programmable timer circuit 46.

As indicated above, not only is the light 40 turned on when the timed relay coil 20 is energized and turned off when it is deenergized, but it is also rapidly turned on and off while the programmable timer circuit 46 is timing. To accomplish this blinking mode of operation, the light driver circuit 48 is also connected to the reset terminal 76 on the oscillator/timer 75 through a lead 111 and is connected to the oscillator/timer output 86 through a lead 112. The lead 111 is connected through an inverter gate 113 to an input on a third NAND gate 114 and to an input on a fourth NAND gate 115. The lead 112 is similarly connected through an inverter gate 116 to second inputs on the NAND gates 114 and 115. The output of the fourth NAND gate 115 connects to a second input on the first NAND gate 105 and the output of the third NAND gate 114 connects to an inverter gate 117 and to a second input on the second NAND gate 106. The output of the inverter gate 117 is coupled through a capacitor 118 and resistor 119 to a third input on the third NAND gate 114 and the capacitor 118 is coupled to the input of the inverter gate 117 through a resistor 120. The NAND gate 114 and inverter gate 117 form an inverter oscillator which generates a two-Hertz square wave to the second NAND gate 106. The frequency of oscillation, or blinking, is determined by the values of the capacitor 118 and the respective resistor 120 and 119.

Operation

Two modes of operation of the circuit in FIG. 4 will now be described with reference to the graphs in FIGS. 5*a* and *b*. These modes are selected by inserting a properly shaped molded insert 42 into the four-pole switch receptacle 41. The insert 42 operates the first pole 80 and the fourth pole 102 to enable the circuit and select the mode and it operates the second and third poles 97 and 99 to select one of four time intervals. When no inserts 42 are in place, the fourth pole 102 opens to disable the driver circuit 47 and light driver circuit 48.

An ON DELAY molded insert 42 closes the first pole 80 and the fourth pole 102. Referring particularly to FIGS. 4 and 5*a*, when a signal is applied to the timed control terminals 21 at time T1 as illustrated by graph 121, a logic low voltage is generated at circuit output terminal 72 and applied to one input of the exclusive OR gate 77. The other input on the gate 77 is held at a logic low voltage by the pole 80, and as a result, its output is driven to a logic low voltage which is applied to the reset terminal 76 on the oscillator/timer 75. Driving the reset terminal low sets the interval counter to zero and starts the timed interval. Concurrently, the logic low at the output of exclusive OR gate 77 is coupled through the lead 111 where it is inverted by the gate 113 and applied to the NAND gate 114 in the light driver circuit 48. As the oscillator/timer 75 is timing, its output 86 is at a logic low voltage. This is inverted by the gate 116 in the light driver circuit 48 and is applied to the NAND gates 114 and 115. As a result, the inverter oscillator comprised of NAND gate 114 and inverter gate 117 generates an oscillating logic signal to one input of the NAND gate 106 which is coupled through to the transistor 108 to blink the timing light 40 as illustrated by graph 122.

During the timed interval both inputs to the output exclusive OR gate 85 are at a logic low voltage, and as a result, a logic low is generated at its output and coupled through the resistor 88 to the driver circuit 47 where it holds the transistor 100 in its nonconductive state. The timed relay coil 20 is thus maintained in its deenergized state as indicated by the graph 123.

When the oscillator/timer 75 "times out" it generates a logic high voltage at its output terminal 86. This is applied through the lead 112 to the light driver circuit 48 to disable the inverter oscillator therein and it is applied to the exclusive OR gate 85 to generate a logic high voltage at its output. The blinking of the light 40 is thus terminated and the logic high voltage generated on the lead 87 is coupled through NAND gates 105 and 106 to energize the light 40. The logic high voltage at the output of the exclusive OR gate 85 is also coupled to the driver circuit 47 to turn on the transistor 100. The timed relay coil 20 is thus energized when the timed interval terminates at time T2, as indicated by the graph 123. Both the timing light 40 and the timed relay coil 20 are driven to their deenergized state when the 120-volt a-c signal is removed from the timed control terminals 21 at a later time T3.

Referring particularly to FIGS. 4 and 5*b*, when an OFF DELAY molded insert 42 is employed in the switch receptacle 41, the first pole 80 is opened and the fourth pole 102 is closed. As a result, the lead 74 which connects to one input on each exclusive OR gate 77 and 85 in the programmable timer circuit 46 is held at a logic high voltage by the resistor 79. Consequently, the oscillator/timer 75 is responsive to start the timed interval upon removal of the 120-volt a-c signal from the timed control terminals 21 as will now be described. When the 120-volt a-c signal is removed from the terminals 21 at time T1 as shown by graph 124, a logic high voltage is generated at the actuator and driver circuit output 72 and a logic low voltage is consequently applied to the reset terminal 76 on the oscillator/timer 75. The timed interval is thus initiated as shown by the graph 125 and the light driver circuit 48 begins to blink the timing light 40 as shown in graph 126. During timing a logic high voltage is generated at the output of exclusive OR gate 85 and this maintains the timed relay coil 20 in its energized state. When the oscillator/timer 75 times out at time T2, its output terminal 86 is driven to a logic high voltage which is coupled through the lead 112 to terminate the blinking. The output of exclusive OR gate 85 also is driven to a logic low voltage and this is coupled to the driver circuit 47 and the light driver circuit 48 to deenergize the timed relay coil 20 and the timing light 40. When the 120-volt a-c signal is again applied to the terminals 21 at a later time T3, a logic low voltage is generated at the actuator and driver circuit output terminal 72 and the reset terminal 76 on the oscillator/timer 75 is thus driven to a logic high voltage in preparation for the initiation of the next timed interval.

The NAND gate 81 which connects to the set terminal 82 on the oscillator/timer 75 insures that timing is not initiated when the circuit is first turned on and the power supply voltages are rising to their proper operating values. The value of capacitor 84 is chosen to hold one input of the NAND gate 81 low during turn on and to thus momentarily inhibit operation of the oscillator/timer 75.

Although the preferred embodiment of the circuit described above includes a particular combination of integrated circuits and discrete components, it should be apparent to those skilled in the art that the circuit can be constructed entirely from discrete components. In the alternative, many of the discrete components such as those in the light driver circuit 48 and the programmable timer circuit 46 may be incorporated into an integrated circuit along with the oscillator/timer 75. These and other variations can be made without departing from the spirit of the invention, and reference is therefore made to the following claims for interpreting the breadth of the invention.

We claim:

1. In a sealed contact relay, the combination comprising:

a base section having a housing which encloses a power supply that includes a transformer;

an energizing and switch section having a housing which mounts to said base section housing and having a timed relay coil and associated magnetic circuit;

a sealed contact switch cartridge mounted to said energizing and switch section housing and magnetically coupled to said timed relay coil by said magnetic circuit for operation thereby; and a timing section having a housing which mounts to said energizing and switch section housing on the side opposite said base section and which encloses a digital programmable timer that electrically connects through a flexible cable to said energizing and switch section to control said timed relay coil and which connects through said flexible cable to said base section to receive power therefrom.

2. The sealed contact relay as recited in claim 1 in which a timing light is mounted to said timing section housing and is electrically coupled to said digital programmable timer.

3. In a sealed contact relay, the combination comprising:

a base section having a housing which encloses a power supply that includes a transformer;

an energizing and switch section having a housing which mounts to said base section housing and having a timed relay coil and associated magnetic circuit;

a sealed contact switch cartridge mounted to said energizing and switch section housing and magnetically coupled to said timed relay coil by said magnetic circuit;

a timed section having a housing which mounts to said energizing and switch section housing and which encloses a digital programmable timer that electrically connects to control said timed relay coil; and a switch receptacle mounted to said timing section housing and being electrically connected to said digital programmable timer, wherein said switch receptacle is adapted to receive a shaped insert which programs said digital programmable timer.

4. In a sealed contact relay, the combination comprising:

a pair of control terminals;

an actuation circuit having inputs connected to said control terminals and having an output terminal, said actuation circuit including means for converting an a-c signal applied to said control terminals to a corresponding logic signal which is generated at said output terminal;

a digital programmable timer circuit having an input connected to said actuation circuit output terminal and having an output terminal, said digital programmable timer including means responsive to the logic signal generated by said actuation circuit to generate a corresponding logic signal at its output terminal at a selected time interval thereafter;

a relay coil;

a driver circuit which connects to said relay coil and which connects to said digital programmable timer circuit output terminal, said driver circuit being operable to drive said relay coil to a state indicated by said corresponding logic signal; and in which said digital programmable timer circuit includes a multi-pole switch receptacle adapted to receive uniquely shaped inserts, said switch receptacle being operable in response to a received insert to program said digital programmable timer circuit by selecting one of a plurality of selectable time intervals.

5. The sealed contact relay as recited in claim 4 which includes:

a light driver circuit having one input connected to the input of said digital programmable timer circuit, having a second input connected to the output terminal of said digital programmable timer circuit, and having an output terminal; and a light connected to said light driver circuit output terminal, wherein said light driver circuit is operable to drive said light to a state indicated by the logic signal applied to its second input terminal and is operable in response to the logic signals applied to both of its input terminals to blink said light during said selected time interval.

6. The sealed contact relay as recited in claim 4 in which said actuation circuit includes an optical isolator which physically and electrically isolates said control terminals from said digital programmable timer.

7. The sealed contact relay as recited in claim 4 which includes a power supply having an isolation transformer with a primary winding connectable to a source of a-c power and with a secondary winding, said power supply also having a rectifier circuit which connects to the secondary winding of said isolation transformer and which has an output that connects to said digital programmable timer circuit and said driver circuit.

* * * * *